United States Patent [19]

Katsuoka et al.

[11] 4,046,999

[45] Sept. 6, 1977

[54] LOGARITHMIC FUNCTION GENERATING SYSTEM

[75] Inventors: Ritsu Katsuoka, Okazaki; Hisasi Kawai, Toyohashi; Seiji Morino, Okazaki, all of Japan

[73] Assignee: Nippon Soken, Inc., Nishio, Japan

[21] Appl. No.: 681,744

[22] Filed: Apr. 29, 1976

[30] Foreign Application Priority Data

June 16, 1975 Japan ..... 50-72892

[51] Int. Cl.[2] ..... G06J 1/00; G06G 7/24

[52] U.S. Cl. ..... 235/150.53; 235/197; 328/145

[58] Field of Search ..... 235/150.53, 197, 183; 328/145; 340/347 AD, 347 DA; 324/132

[56] References Cited

U.S. PATENT DOCUMENTS

| | | | |
|---|---|---|---|
| 3,579,127 | 5/1971 | Thomas | 328/145 |
| 3,649,826 | 3/1972 | Larsson et al. | 235/150.53 X |
| 3,805,046 | 4/1974 | Magnussen, Jr. | 328/145 X |
| 3,828,255 | 8/1974 | Schuon | 328/145 X |
| 3,878,383 | 4/1975 | Uchida | 235/197 X |

*Primary Examiner*—Joseph F. Ruggiero

*Attorney, Agent, or Firm*—Cushman, Darby & Cushman

[57] ABSTRACT

A logarithmic function generating system which generates an output signal bearing a logarithmic functional relation to the input signal. The time constant RC of a resistance-capacitance circuit is increased for every unit time elapsed in proportion to the unit time to produce a broken line approximating the logarithmic function. With its simple circuit construction employing no elements whose characteristics vary with ambient temperature changes or which tend to involve variations in characteristics among the elements of the same type, the system is capable of generating the desired logarithmic function output with a high degree of accuracy.

6 Claims, 4 Drawing Figures

LOGARITHMIC FUNCTION GENERATING SYSTEM

BACKGROUND OF THE INVENTION

1. Field of the Invention

The present invention relates to a logarithmic function generating system wherein the time constant of a time constant circuit is increased successively and a logarithmic function with a time as a variable is generated by approximating it with a broken line.

2. Description of the Prior Art

The logarithmic function generators heretofore known in the art include for example analog type logarithmic function generators wherein the fact that the voltage-current characteristic of diodes is a logarithmic characteristic is utilized to generate an output voltage bearing a logarithmic relation to the input voltage and digital type logarithmic function generators wherein a logarithmic function is generated in an approximate manner in accordance with series expansion formulas of the logarithmic function. In the case of the former analog type generators, due to nonuniformity in the characteristics of diodes of the same type, it has been difficult to obtain logarithmic function generators having the uniform characteristics. There has been another disadvantage that the characteristics of diodes are liable to change with temperature changes and hence the resulting logarithmic function voltage is unstable.

In the case of the digital type generators, it has been necessary to use a complicated computing circuit for realizing the required series expansion formulas. There has been another disadvantage that the circuit construction tends to become extremely large and complicated in order to ensure a high degree of accuracy.

SUMMARY OF THE INVENTION

It is an object of this invention to provide a logarithmic function generating system which employs no such elements whose characteristics vary considerably with changes in the ambient temperature or such elements which tend to involve variations in the characteristics among the elements of the same type, but is capable of generating highly accurate logarithmic function voltages with a simple circuit construction.

In accomplishing the above and other equally desirable objects, the logarithmic function generating system provided in accordance with this invention is designed so that clock signals having a predetermined frequency are counted to change a time constant in accordance with a setting signal which is changed gradually each time a predetermined unit time expires, and a capacitor voltage is developed with a charging slope gradually varying with changes in the time constant, whereby the capacitor voltage gives a broken line approximation to a logarithmic function with a time as a variable.

The system of this invention has among its great advantages the fact that it is capable of generating a logarithmic function voltage with a high degree of accuracy using a very simple circuit construction which is realized through the combination of the digital operation of a time constant setting circuit and the analog operation of a time constant circuit.

DESCRIPTION OF THE PREFERRED EMBODIMENT

The present invention will now be described in greater detail with reference to the illustrated embodiment.

The basic principles of the system of this invention will be described first with reference to the characteristic diagrams of FIGS. 1 and 2. With the logarithmic function $V = k.\log t$ (where V and $t$ are variables and $k$ is a constant) shown in FIG. 1, $dV/dt = k\,.\,(1/t)$. Consequently, where the variable $t$ changes by a fixed value $t_o$ as $t_0, 2t_0, 3t_0, \ldots, nt_0$ ($n$ is an integer), the slope of the tangent to the curve at each of the corresponding points $A_1, A_2, A_3, \ldots, A_n$ is given as follows. Namely, assuming that $M_1$ represents the slope of the tangent at the point $A_1$, then the slopes of the tangents at the points $A_1, A_2, A_3, \ldots, A_n$ are given as $M_1, M_1/2, M_1/3, \ldots, M_1/n$ which are inversely proportional to the variable $t$.

If these tangents are connected to one another, the resulting broken line approximates the logarithmic function $V = k\,.\,\log t$. In this case, it is evident that the smaller the value of the fixed value $t_0$ is, the greater the accuracy of approximation of a logarithmic function with a broken line becomes.

These tangents will now be examined in greater detail. With the logarithmic function $V = k.\log t$, if the variable $t$ is replaced with a time and the variable V is replaced with a voltage as shown in FIG. 2, where the value of the fixed value $t_0$ is sufficiently small, each of the tangents may be approximated by the charging curve of a resistance-capacitance circuit obeying an equation $V = E.[1\text{-}\exp(-(1/RC).\,t)]$. In this equation, E is a constant voltage, R is the resistance value of a resistor and C is the capacitance value of a capacitor. The reason for this is that the slope of the tangent of the resistor-capacitor charging curve given by the above equation is given as $dV/dt = E.\exp(-\,t/RC)/RC$, so that if $RC >> t$, then the slope of the tangent may be approximated as $dV/dt = E.(1/RC)$. This equation is of the same form as the tangent slope equation $dV/dt = k.(1/t)$ for the logarithmic function $V = k.\log t$. Consequently, to fit the charging curve to each of the tangents of the logarithmic function $V = k.\log t$ which are shown by the dotted lines in FIG. 1, it is necessary that the time constant $\tau$ in the equation $V = E[1\text{-}\exp(-(1/RC).t)]$ is increased successively as RC, 2RC, 3RC, . . . , $n$RC as the time $t$ in the equation $V = k.\log t$ is increased as $t_0, 2t_0, 3t_0, \ldots, nt_0$ by a unit time $t_0$, thereby producing a curve that approximates the broken line approximation to the logarithmic function $V = k.\log t$.

Figure 3:
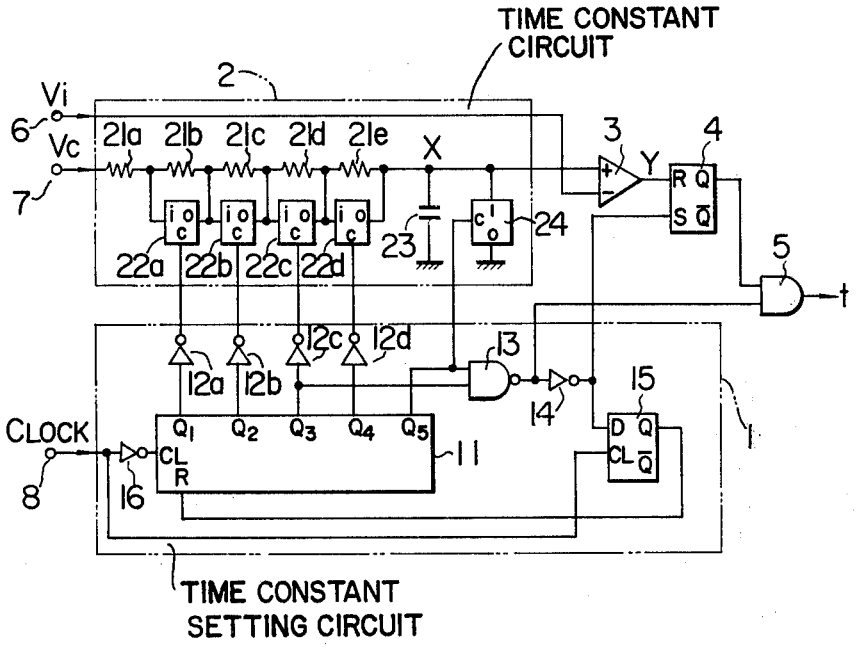
FIG. 3 is a wiring diagram showing an embodiment of the system of this invention.

Referring now to FIG. 3 showing a wiring diagram for an embodiment of the system of this invention, numeral 1 designates a time constant setting circuit for generating a setting signal corresponding to the number of input pulse signals, 2 a resistance-capacitance time constant circuit (hereinafter simply referred to as an RC charging circuit) whose time constant varies in accordance with the output setting signal of the time constant setting circuit 1. The detailed constructions of these circuits are as follows. The time constant setting circuit 1 comprises a binary counter 11 (such as the Motorola MC 14040), inverters 12*a*, 12*b*, 12*c* and 12*d* respectively connected to the first-position to fourth-position outputs $Q_1$, $Q_2$, $Q_3$ and $Q_4$ of the binary counter 11, a NAND gate 13 for receiving as its inputs the third-position output $Q_3$ and fifth-position output $Q_5$ of the binary counter 11, an inverter 14 for inverting the output of the NAND gate 13, a D-type flip-flop 15 for delaying the output of the NAND gate 13 and applying it to a reset terminal R of the binary counter 11 and an inverter 16 connected to a clock input terminal CL of the binary counter 11. The RC charging circuit 2 comprises series-connected resistors 21*a* and 21*b* of a resistance value R, resistor 21*c* of a resistance value 2R, resistor 21*d* of a resistance value 4R and resistor 21*e* of a resistance value 8R, analog switches 22*a*, 22*b*, 22*c* and 22*d* (such as the RCA CD4016) respectively connected to the ends of the resistors 21*b*, 21*c*, 21*d* and 21*e* and disposed to receive as their control inputs the outputs of the inverters 12*a* to 12*d*, respectively, a capacitor 23 having a capacitance value C and connected to the end of the resistor 21*e* and an analog switch 24 connected in parallel with the capacitor 23 and disposed to receive as its control input the fifth-position output $Q_5$ of the binary counter 11. Numerals 6, 7 and 8 designate terminals for respectively receiving a preset voltage $V_i$, constant voltage $V_c$ and clock signals of a predetermined frequency. In this embodiment, as shown in FIG. 3, there are further provided a comparator 3, an R-S flip-flop 4 and an AND gate 5 so that a pulse signal of a time width bearing a logarithmic relation to the preset voltage $V_i$ applied to the terminal 6 is generated.

Figure 4:
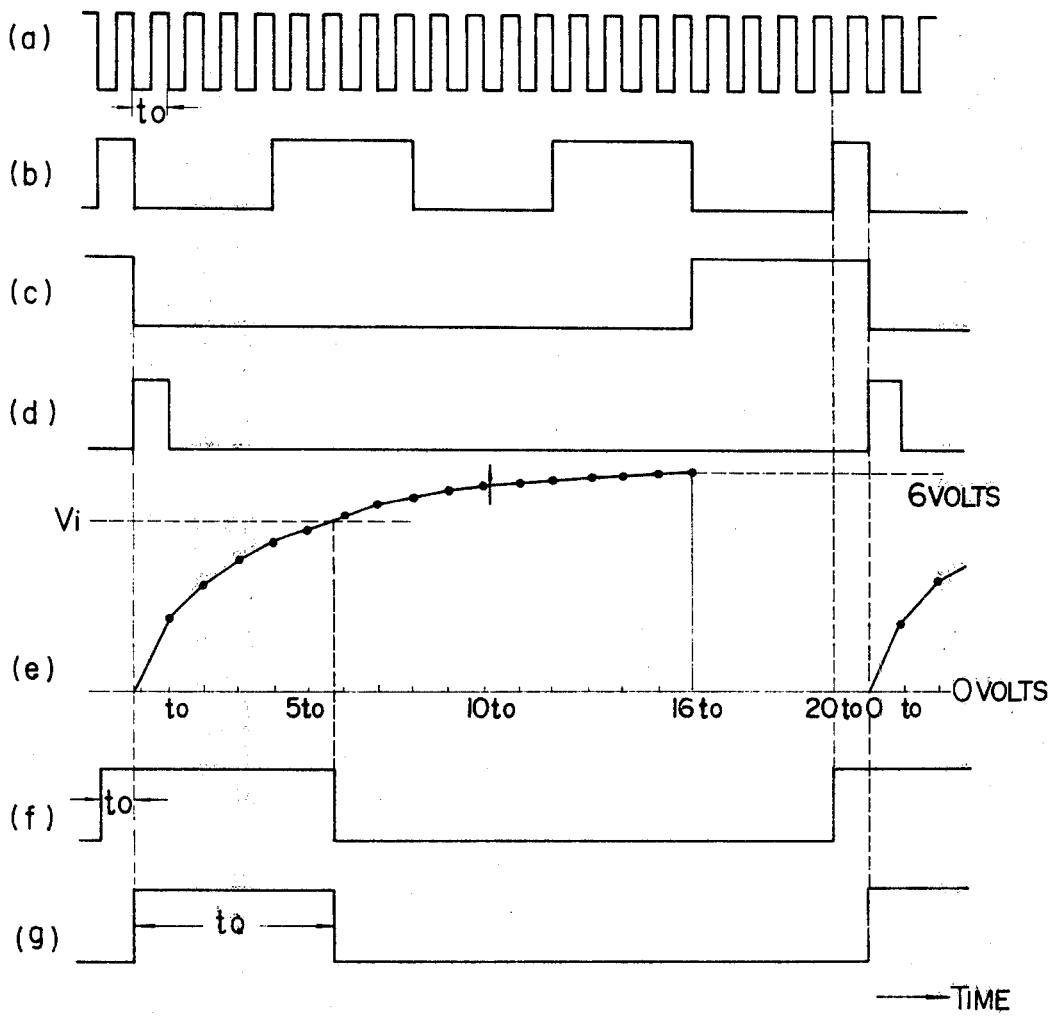
FIG. 4 is a waveform diagram useful for explaining the operation of the system of this invention.

With the construction described above, the operation of this embodiment will now be described with reference to FIG. 4. When the reset signal shown in (*d*) of FIG. 4 is applied to the reset terminal R of the binary counter 11, the binary counter 11 is reset so that all of the outputs $Q_1$ to $Q_5$ go to a low level (hereinafter simply designated by a logical symbol 0) and all of the outputs of the inverters 12*a* to 12*d* go to a high level (hereinafter simply designated by a logical symbol 1). On the other hand, when a 1 control input is applied to the control input terminal *c* of each of the analog switches 22*a* through 22*d*, conduction occurs between its input terminal *i* and output terminal *o*, whereas when a 0 control input is applied to the control input terminal *c* the conduction between the input and output terminals *i* and *o* is terminated. Thus, when the binary counter 11 is reset, the analog switches 22*a* to 22*d* are all turned on and only the analog switch 24 is turned off. In this condition, the resistance value between the terminal 7 and a point X in FIG. 3 is R and the potential at the point X rises according to a function $V = VC.(1\text{-}\exp(-t/RC))$ as shown in (*e*) of FIG. 4. Assuming that the clock signals having a predetermined frequency and applied to the binary counter 11 has a period $t_0$ as shown in (*a*) of FIG. 4, at the expiration of the unit time $t_0$ after the application of the reset signal, the count of the binary counter 11 is advanced by 1 so that the first-position output $Q_1$ goes to 1 and the other outputs $Q_2$ to $Q_5$ go to 0. Consequently, the analog switch 22*a* is turned off, while the analog switches 22*b* to 22*d* remain on and the analog switch 24 also remains off, causing the resistance value between the terminal 7 and the point X to become 2R. Thus, the potential at the point X starts rising with a time constant 2RC as shown in (*e*) of FIG. 4 after the expiration of the time $t_0$. Thereafter, each time the unit time $t_0$ expires, the time constant of the RC charging circuit 2 is increased in proportion to the time expired, thus increasing the time constant from RC to 2RC, 3RC, . . . , 16RC. Thus, as shown in (*e*) of FIG. 4, the voltage waveform generated at the point X consists of 16 interconnected charging curves with different time constants and it is evident that as previously noted this voltage waveform approximately realizes the broken line approximation to the logarithmic function which is shown by the dotted lines in FIG. 1.

Then, at the expiration of 16 $t_0$ times after the application of the reset signal, all of the outputs $Q_1$ through $Q_4$ of the binary counter 11 go to 0 and the fifth-position output $Q_5$ shown in (*c*) of FIG. 4 goes to 1. Consequently, the analog switches 22*a* to 22*d* and 24 are all turned on and the charge stored in the capacitor 23 is discharged decreasing the potential at the point X instantaneously to 0 volt as shown in (*e*) of FIG. 4. Thereafter, when 4 clock signals are applied further to the binary counter 11, the third-position output $Q_3$ of the binary counter 11 which is shown in (*b*) of FIG. 4, goes to 1 and the output of the NAND gate 13 goes to 0. The output of the NAND gate 13 is inverted by the inverter 14, delayed by one clock period or unit time $t_0$ and then applied to the reset terminal R of the binary counter 11. When this occurs, the binary counter 11 is reset clearing all of its outputs $Q_1$ to $Q_5$ to 0 and restoring the initial conditions and the RC charing circuit 2 starts again its charging action with the time constants RC, 2RC, 3RC, . . . . In this embodiment, the inverter 16 is connected to the clock input terminal CL of the binary counter 11 to adjust the phase relationships between the binary counter 11 and the D-type flip-flop 15 since the binary counter 11 counts the applied clock signals at their falling edges and the D-type flip-flop 15 changes its state in response to the rising edges of the clock signals.

The point X is also connected to the noninverting input of the comparator 3 which compares the voltage at the point X with the preset voltage $V_i$ which is applied to its inverting input. Since the output of the comparator 3 is connected to a reset terminal R of the R-S flip-flop 4 and the output of the inverter 14 is connected to the set input terminal of the R-S flip-flop 4, when the count value of the binary counter 11 reaches 20 so that the third-position output $Q_3$ the fifth-position output $Q_5$ go to 1, the output of the inverter 14 goes to 1 and the R-S flip-flop 4 is set causing its Q output to go to 1 as shown in (*f*) of FIG. 4. Then, when the voltage at the point X rises and becomes higher than the preset voltage $V_i$ applied to the inverting input of the comparator 3, the output of the comparator 3 goes from 0 to 1. As a result, the R-S flip-flop 4 is reset and its Q output goes to 0 producing the pulse width shown in (*f*) of FIG. 4. The Q output of the R-S flip-flop 4 and the output of the inverter 14 are applied to the AND gate 5 so that the time width $t_0$ of the set pulse is substracted from the pulse width shown in (*f*) of FIG. 4 and the pulse of the pulse width $t_Q$ shown in (*g*) of FIG. 4 is generated at the output of the AND gate 5. In this case, it is evident that a relation approximating to the equation $V_i = k.\log t_Q$ (where $k$ is a constant) holds between the time width $t_Q$ and the preset voltage $V_i$. The R-S flip-flop 4 serves to prevent the occurrence of a chattering phenomenon to the output of the comparator 3 due to the effect of the accuracy of detection or the response characteristics of the comparator 3. In other words, once a 1 has been applied to the reset input R of the R-S flip-flop 4 changing its Q output to 0, the Q output remains in the same state until a 1 is applied to the set input S and in this way any chattering produced in the output of the comparator 3 is cancelled.

In the above-described embodiment, while the charging time constant for each interval is increased in proportion to the $t$, due to the fact that the voltage rise $V_{n-1}$ up to the end of the preceding interval is added as an initial charge, a potential $V_n$ at the point X for the $n$-th interval is given by the following equation:

$$V_n = (V_c - V_{n-1}).[1\text{-}\exp(-t/n\mathrm{RC})] + V_{n-1}$$

Modifying the above equation yields:

$$dV_n/dt = (V_c - V_{n-1}).\exp(-t/nRC)/nRC$$

Figure 1:
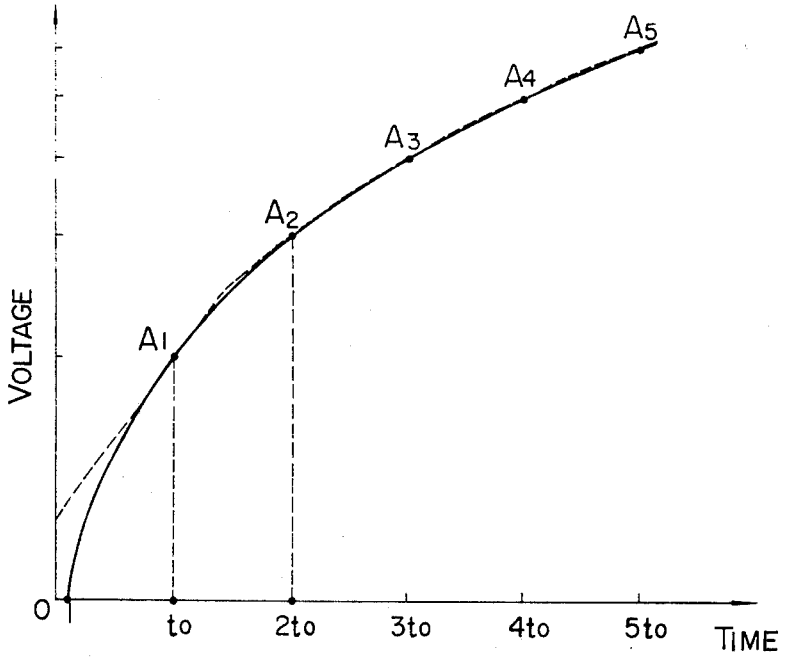
FIG. 1 is a characteristic diagram useful in explaining the principles of a logarithmic function generating system according to the invention.
Figure 2:
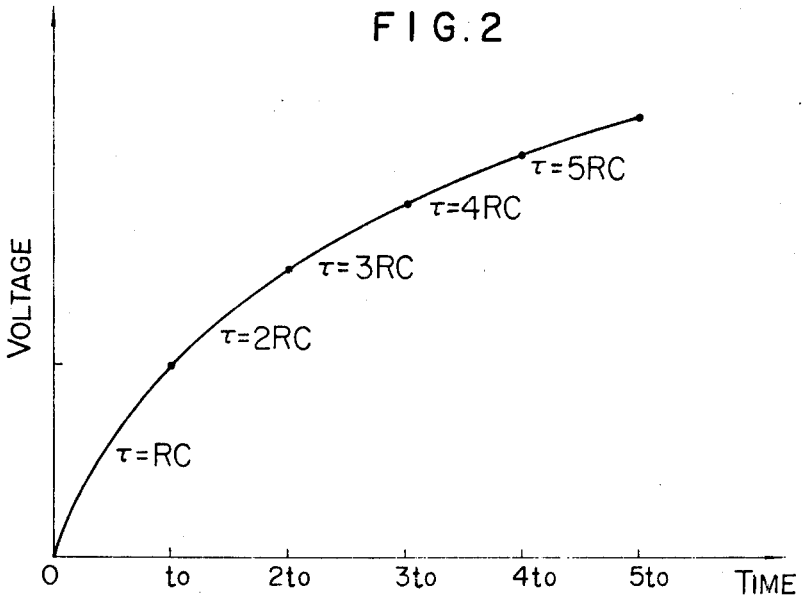
FIG. 2 is a time-voltage characteristic diagram useful for explaining the principles of the system of this invention.

Thus, the slope of the tangent is no longer inversely proportional to the time and slopes gradually deviate from the broken line shown by the dotted lines in FIG. 1. However, it has been found that if the frequency of clock signals and the constant voltage $V_c$ are respectively selected 4096 Hz and 6 V, with a specified time constant, the resulting approximation errors with respect to the computed values would be less than ±3% under a range 200 (μsec) < $t_Q$<3.5 (m sec), making it possible to produce with a sufficiently high degree of accuracy a logarithmic function voltage with a time as a variable and put it to practical use. Further, if the clock signal frequency is increased, the desired approximation accuracy may be obtained even if the predetermined time constant is decreased, while the similar approximation accuracy may be obtained by setting the frequency and the time constant conversely. Still further, it is possible to correct the previously mentioned deviations with the lapse of time so as to ensure the desired approximation accuracy over a wide range of intervals.

In the system of this invention, those elements which involve the problem of nonuniformity of characteristics or the problem of temperature characteristics are only the resistors 21*a* through 21*e* and the capacitor 23 constituting the RC charging circuit 2. However, the ordinary resistors such as metal film resistors which are stable and highly accurate with a variation of about ±1% and a temperature coefficient of ± 50 ppm/° C are available. Also, the ordinary type capacitors, such as, ceramic capacitors and polyester film capacitors whose temperature coefficients are almost zero are available. Furthermore, nonuniformity in the capacitance of capacitors of the same type is included in the constant $k$ of the logarithmic function $V = k.\log t$ and is easily adjustable. Thus, it is possible to provide a stable and highly accurate logarithmic function generating system in which the variations in the characteristics of the elements are reduced or the effects of the temperature characteristics are reduced.

Further, while the analog switches 22*a* through 22*d* are controlled to change the time constant of the RC charging circuit 2, this control may be accomplished with only the binary counter 11 and the inverters 12*a* through 12*d* simplifying the circuitry considerably. Still further, since a pulse of the time width $t_Q$ can be easily generated, it is possible to easily obtain the number of clock pulses proportional to the output pulse width $t_Q$ through such an operation by which the number of clock signals applied during the time width $t_Q$ is counted and thus the system of this invention may be made to serve such functions as served by analog-to-digital converters.

Further, while, in the above-described embodiment the desired logarithmic function voltage is approximated with 16 RC charging curves having different time constants, by increasing the number of bit positions in the binary counter 11 and adding as many analog switches and resistors as desired to the analog switches 22*a* and 22*d* and the resistors 21*a* to 21*e,* it is possible to approximate with increased accuracy the desired logarithmic function voltage with a broken line including a greater number of segments.

Still further, by grounding the point X, inserting the analog switch 24 between the constant voltage input terminal 7 and the resistor 21*a* and connecting the juncture of the analog switch 24 and the resistor 21*a* to the ground through the capacitor 23, the potential at the juncture of the analog switch 24, the resistor 21*a* and the capacitor 23 may be obtained as a voltage which decreases logarithmically as a variable of a time or an approximating curve $V = -k.\log t$ ($k$ is a constant).

Still further, while the RC charging circuit 2 is designed to change its time constant by varying the resistance value, it is possible to arrange so that a plurality of capacitors are similarly controlled by means of analog switches to vary the total capacitance and thereby to change the time constant.

Still further, by arranging in such a manner that each of $n$ independent resistors or capacitors is separately connected to $n$ analog switches and each of the analog switches is controlled by a counter with a divider, the time constant for each interval may be determined by means of the single resistor or capacitor and therefore it is possible to generate with greater accuracy the desired logarithmic function voltage with a time as a variable by strictly adjusting the resistance values or capacitance values. Further, the resistance-capacitance (R-C) time constant circuit may be replaced by a resistance-inductance (R-L) time constant circuit as well without departing from the scope of this invention.

We claim:

1. A logarithmic function generating system comprising:

a time constant setting circuit for counting clock signals having a predetermined frequency to generate a setting signal varying at every passing of a unit time; and a time constant circuit connected to said time constant setting circuit and including a capacitor, said capacitor being charged with a time constant which is constant during said unit time and is proportionally increased at said every successive unit time, whereby the voltage across said capacitor gives a broken line approximation to a logarithmic function with time as a variable.

2. A system according to claim 1 further comprising a comparison circuit for comparing the voltage across said capacitor with an input voltage applied thereto to generate a pulse having a time width bearing a logarithmic relation to said input voltage.

3. A system according to claim 1, wherein said time constant circuit includes a string of resistors connected in series for receiving a predetermined voltage at one end thereof and charging said capacitor connected to the other end thereof, and switching means responsive to the setting signal from said time constant setting circuit to increase the resistance value of said string by a predetermined value equal to one which is set during the first unit time.

4. A logarithmic function generating system comprising:

a counter for counting clock signals having a predetermined frequency to generate a setting signal at every passing of a unit time, said setting signal consisting of a plurality of bits;

a set of resistors supplied with a predetermined voltage at one end thereof and connected to said counter for varying the total resistance value thereof in proportion to said setting signal; and a capacitor connected to the other end of said set of resistors to be charged with a time constant which is constant during each unit time and is proportionally increased at each successive said unit time, whereby a logarithmic function with time as a variable is generated by a voltage developed across said capacitor.

5. A system according to claim 4 further comprising resetting means connected to said counter to reset the count of said counter at intervals of a predetermined time.

6. A system according to claim 5 further comprising discharge control means connected to said capacitor and said counter to control the discharging of said capacitor in accordance with the count value of said counter.

* * * * *